US011713174B1

(12) United States Patent
Young et al.

(10) Patent No.: US 11,713,174 B1
(45) Date of Patent: Aug. 1, 2023

(54) LUMINESCENT STORAGE ASSEMBLY

(71) Applicants: Jennifer Young, Rancho Palos Verdes, CA (US); Lilia Stephenson, San Pedro, CA (US)

(72) Inventors: Jennifer Young, Rancho Palos Verdes, CA (US); Lilia Stephenson, San Pedro, CA (US)

( * ) Notice: Subject to any disclaimer, the term of this patent is extended or adjusted under 35 U.S.C. 154(b) by 0 days.

(21) Appl. No.: 17/964,878

(22) Filed: Oct. 12, 2022

(51) Int. Cl.

| | |
|---|---|
| ***B65D 77/22*** | (2006.01) |
| ***B65D 43/16*** | (2006.01) |
| ***B65D 25/04*** | (2006.01) |
| ***F21K 2/00*** | (2006.01) |
| ***B65D 25/24*** | (2006.01) |
| ***B65D 77/04*** | (2006.01) |
| ***B65D 51/16*** | (2006.01) |

(52) U.S. Cl.
CPC ..... *B65D 77/22* (2013.01); *B65D 25/04* (2013.01); *B65D 25/24* (2013.01); *B65D 43/16* (2013.01); *B65D 51/1611* (2013.01); *B65D 77/0486* (2013.01); *F21K 2/00* (2013.01)

(58) Field of Classification Search
CPC .. G02B 6/0095; G02B 6/0043; G02B 6/0051; G02B 6/0061; G02B 6/0068; B65D 77/22; B65D 25/04; B65D 25/24; B65D 43/16; B65D 51/1611; B65D 77/0486; F21K 2/00
See application file for complete search history.

(56) References Cited

U.S. PATENT DOCUMENTS

| | | | | |
|---|---|---|---|---|
| 6,594,927 | B2 * | 7/2003 | Witkowski | G09F 3/0288 40/310 |
| 6,921,179 | B2 * | 7/2005 | Diak Ghanem | A47G 19/2288 206/217 |
| 7,556,425 | B2 * | 7/2009 | Gluck | G01K 11/12 374/161 |
| 7,914,165 | B2 * | 3/2011 | Bertken | A47G 19/2227 362/97.3 |
| 7,988,317 | B2 * | 8/2011 | Kang | A45C 11/16 362/154 |
| 9,750,167 | B2 * | 8/2017 | Nash | H05K 9/0047 |
| 2006/0102582 | A1 * | 5/2006 | Wakefield | A47G 19/2227 215/12.1 |
| 2008/0251396 | A1 * | 10/2008 | Oh | A45C 11/16 206/6.1 |
| 2010/0242520 | A1 * | 9/2010 | Weir | F25D 27/00 62/264 |
| 2022/0033166 | A1 * | 2/2022 | Pellegrino | B65B 5/04 |

* cited by examiner

*Primary Examiner* — Arman B Fallahkhair

(57) ABSTRACT

A luminescent storage assembly for storing personal objects includes an ellipsoid that is divided into a first portion hingedly coupled to a second portion for opening and closing the ellipsoid. A container is positionable within the ellipsoid and the container includes a plurality of dividers. Each of the dividers is positioned in the container such that each of the dividers defines a respective one of a plurality of compartments in the container to contain objects for storage. A plurality of luminescent elements is each integrated into the ellipsoid. Each of the luminescent elements is comprised of a luminescent material to facilitate the ellipsoid to be visible in a darkened environment.

11 Claims, 5 Drawing Sheets

LUMINESCENT STORAGE ASSEMBLY

CROSS-REFERENCE TO RELATED APPLICATIONS

Not Applicable

STATEMENT REGARDING FEDERALLY SPONSORED RESEARCH OR DEVELOPMENT

Not Applicable

THE NAMES OF THE PARTIES TO A JOINT RESEARCH AGREEMENT

Not Applicable

INCORPORATION-BY-REFERENCE OF MATERIAL SUBMITTED ON A COMPACT DISC OR AS A TEXT FILE VIA THE OFFICE ELECTRONIC FILING SYSTEM

Not Applicable

STATEMENT REGARDING PRIOR DISCLOSURES BY THE INVENTOR OR JOINT INVENTOR

Not Applicable

BACKGROUND OF THE INVENTION

(1) Field of the Invention

The disclosure relates to storage devices and more particularly pertains to a new storage device for storing personal objects. The storage device includes an ellipsoid which is divided into a first portion that is hingedly coupled to a second portion. The device includes partitions integrated into the second portion to define compartments for storing objects. Additionally, the device includes a plurality of luminescent elements that are distributed over the ellipsoid for facilitating the ellipsoid to be visible in a darkened environment.

(2) Description of Related Art Including Information Disclosed Under 37 CFR 1.97 and 1.98

The prior art relates to storage devices including a luminescent nipple collar for retaining a nipple on a feeding bottle. The prior art discloses a luminescent bottle cap. The prior art discloses a beverage container which has luminescent indicia to facilitate the beverage container to be visible in a darkened environment. The prior art discloses a dental case for storing a dental guard in a suspended manner. The prior art discloses a candy dispenser which includes a cylindrical housing and a plurality of chambers in the cylindrical housing. The prior art discloses a nipple shield which has a luminescent element to facilitate the nipple shield to be visible in a darkened environment. The prior art discloses an ornamental design for a nipple shield case that includes a flattened lower portion and a conical upper portion hingedly coupled to the flattened lower portion.

BRIEF SUMMARY OF THE INVENTION

An embodiment of the disclosure meets the needs presented above by generally comprising an ellipsoid that is divided into a first portion hingedly coupled to a second portion for opening and closing the ellipsoid. A container is positionable within the ellipsoid and the container includes a plurality of dividers. Each of the dividers is positioned in the container such that each of the dividers defines a respective one of a plurality of compartments in the container to contain objects for storage. A plurality of luminescent elements is each integrated into the ellipsoid. Each of the luminescent elements is comprised of a luminescent material to facilitate the ellipsoid to be visible in a darkened environment.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF SEVERAL VIEWS OF THE DRAWING(S)

The disclosure will be better understood and objects other than those set forth above will become apparent when consideration is given to the following detailed description thereof. Such description makes reference to the annexed drawings wherein.

DETAILED DESCRIPTION OF THE INVENTION

Figure 1:
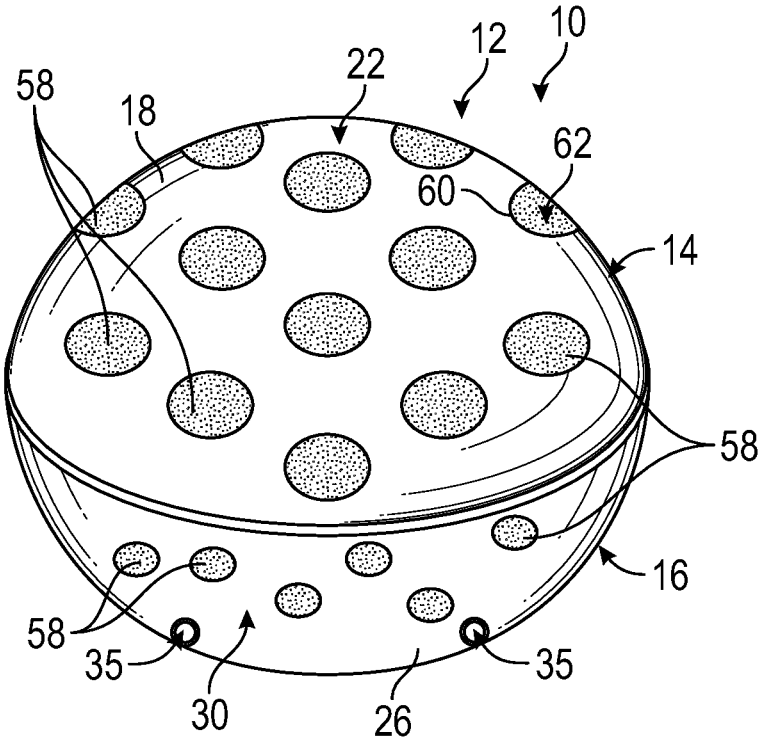
FIG. 1 is a top perspective view of a luminescent storage assembly according to an embodiment of the disclosure.
Figure 2:
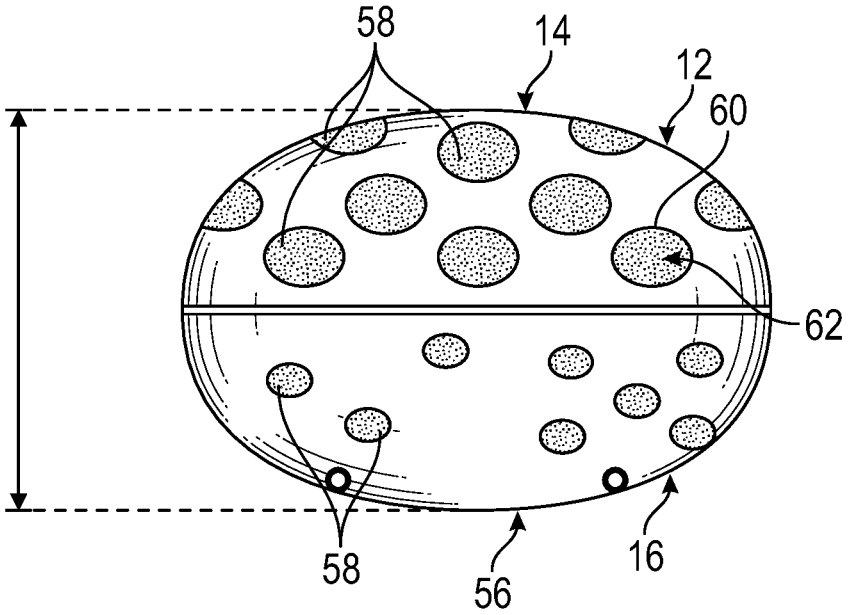
FIG. 2 is a right side view of an embodiment of the disclosure.
Figure 3:
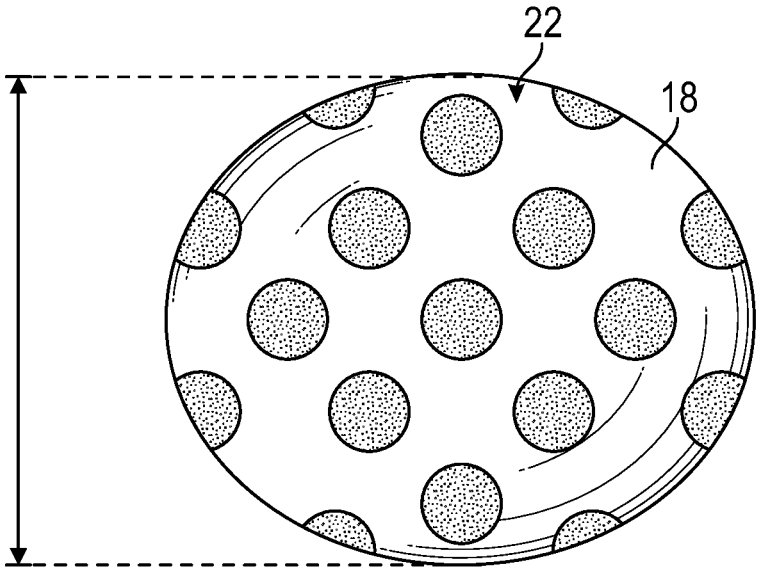
FIG. 3 is a top view of an embodiment of the disclosure.
Figure 4:
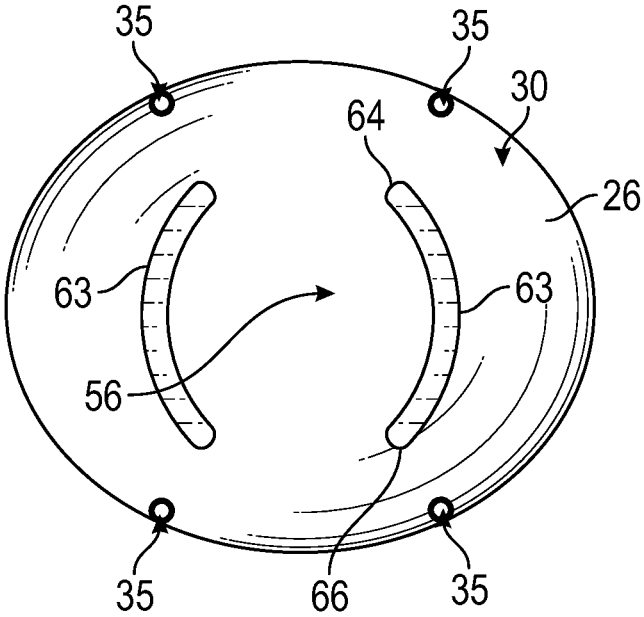
FIG. 4 is a bottom view of an embodiment of the disclosure.
Figure 5:
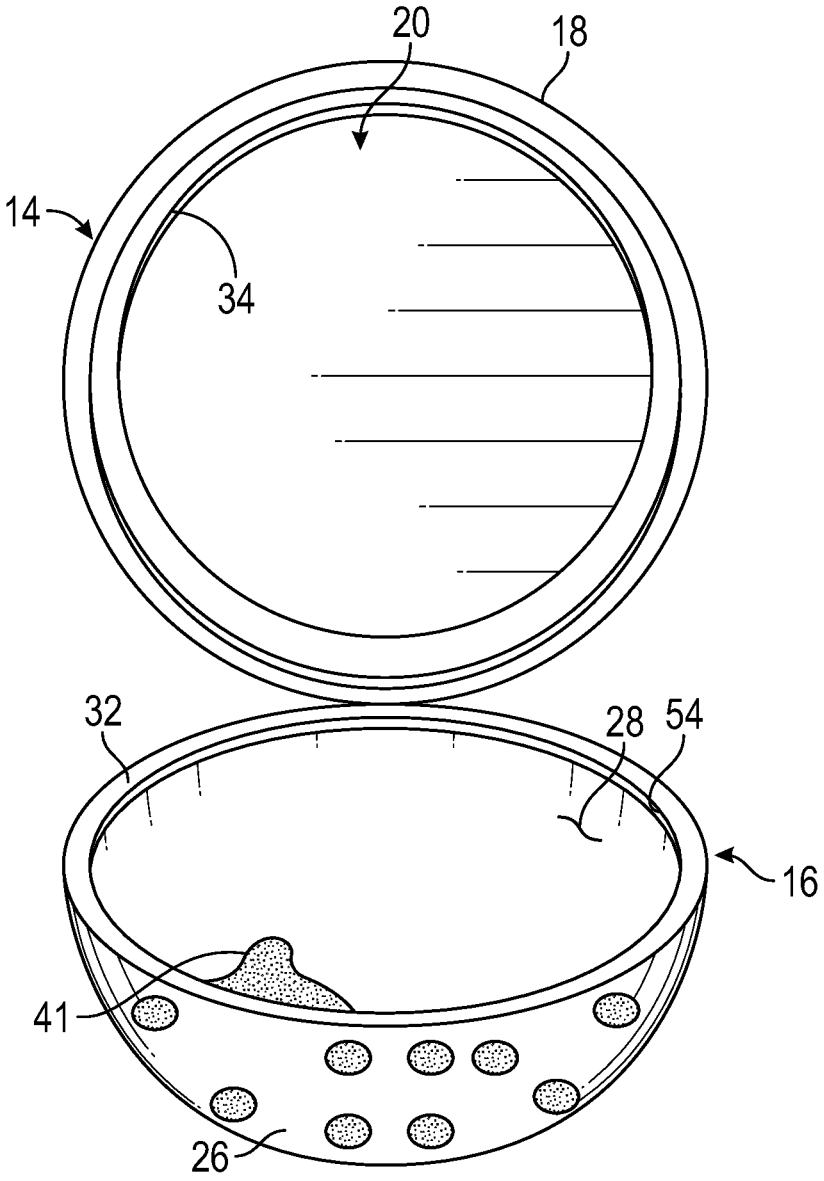
FIG. 5 is a front perspective view of an embodiment of the disclosure showing a first portion and a second portion of an ellipsoid in an open position.
Figure 6:
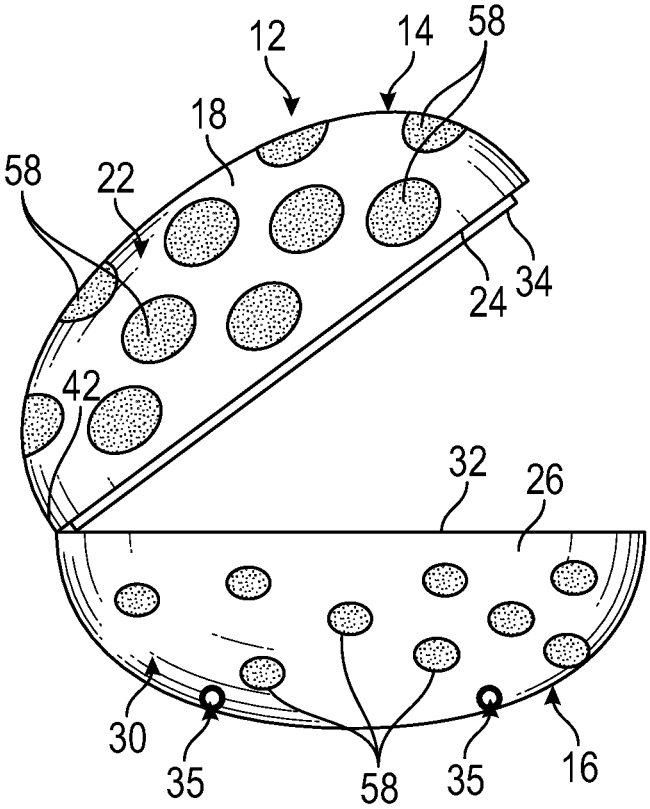
FIG. 6 is a right view of an embodiment of the disclosure showing a first portion and a second portion of an ellipsoid in an open position.
Figure 7:
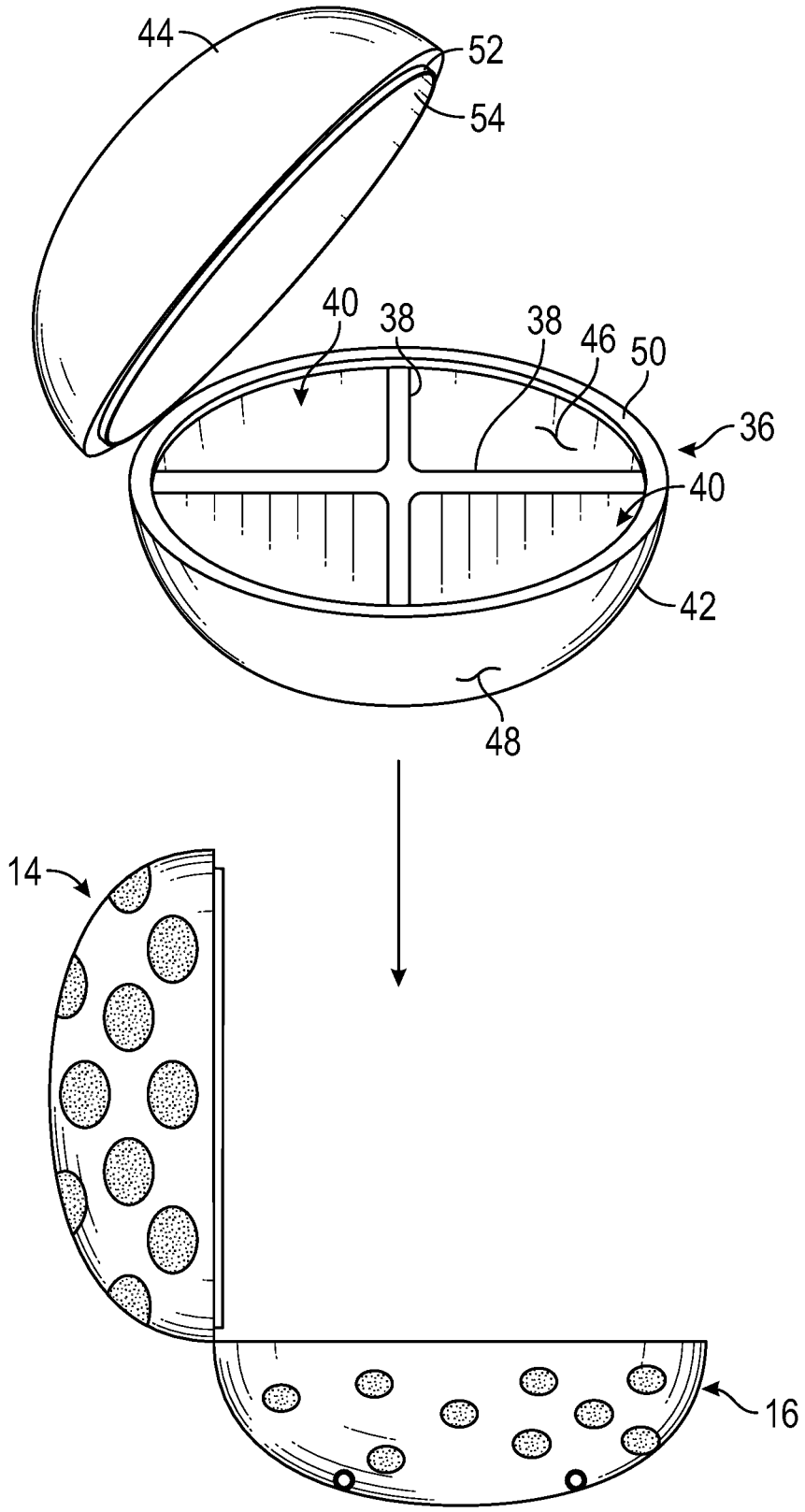
FIG. 7 is an exploded perspective view of the disclosure showing a container that is insertable into an ellipsoid.

With reference now to the drawings, and in particular to FIGS. 1 through 7 thereof, a new storage device embodying the principles and concepts of an embodiment of the disclosure and generally designated by the reference numeral 10 will be described.

As best illustrated in FIGS. 1 through 7, the luminescent storage assembly 10 generally comprises an ellipsoid 12 that is divided into a first portion 14 which is hingedly coupled to a second portion 16 for opening and closing the ellipsoid 12. The first portion 14 has an outer wall 18 and the outer wall 18 has an inside surface 20 and an outside surface 22, and the first portion 14 has a lower edge 24 extending between the inside surface 20 and the outside surface 22. The second portion 16 has an exterior wall 26 and the exterior wall 26 has an interior surface 28 and an exterior surface 30. Furthermore, the second portion 16 has an upper edge 32 extending between the interior surface 28 and the exterior surface 30.

The first portion 14 has a lip 34 extending around a full circumference of the inside surface 20 of the outer wall 18. The lip 34 extends beyond the lower edge 24 of the first portion 14. Moreover, the lower edge 24 rests on the upper edge 32 when the first portion 14 and the second portion 16 are in a closed position. The lower edge 24 is displaced from the upper edge 32 when the first portion 14 and the second portion 16 are in an open position. The second portion 16 has a plurality of air holes 35 each extending through the interior surface 28 and the exterior surface 30 of the exterior wall 26 to pass air through the air holes 35 for ventilating an interior of the ellipsoid 12 when the first portion 14 and the second portion 16 are in the closed position. Moreover, each of the air holes 35 is positioned closer to an apex 56 of the exterior wall 26 of the second portion 16 than the upper edge 32 of the second portion 16.

A container 36 is positionable within the ellipsoid 12 and the container 36 includes a plurality of dividers 38. Each of the dividers 38 is positioned in the container 36 such that each of the dividers 38 defines a respective one of a plurality of compartments 40 in the container to contain objects 41 for storage. The container 36 includes a bowl portion 42 that is concavely arcuate and a lid portion 44 that is hingedly coupled to the bowl portion 42 for opening and closing the bowl portion 42. The bowl portion 42 has an inside surface 46, an outside surface 48 and a top edge 50 extending between the inside surface 46 and the outside surface 48 of the bowl portion 42. The outside surface 48 of the bowl portion 42 conforms to the interior surface 28 of the exterior wall 26 of the second portion 16 of the ellipsoid 12 when the container 36 is positioned in the ellipsoid 12.

The lid portion 44 has a perimeter edge 52 and a bottom surface 54, and the perimeter edge 52 is hingedly coupled to the top edge 50 of the bowl portion 42 such that the bottom surface 54 rests on the top edge 50 when the lid portion 44 is closed. Each of the dividers 38 extends away from the inside surface 46 of the bowl portion 42. Additionally, the plurality of dividers 38 is perpendicularly oriented with each other such that the plurality of dividers 38 intersects each other to define a grid pattern.

A plurality of luminescent elements 58 is provided and each of the luminescent elements 58 is integrated into the ellipsoid 12. Each of the luminescent elements 58 is comprised of a luminescent material such that the luminescent elements 58 facilitate the ellipsoid 12 to be visible in a darkened environment. Each of the luminescent elements 58 has a bounding edge 60 which may be continuously arcuate about a center 62 of the luminescent elements 58 such that each of the luminescent elements 58 has an ovoid shape. Furthermore, the bounding edge 60 of the luminescent elements may define a variety of shapes, including but not being limited to, a star, a square, a circle or any other geometric shape. Additionally, each of the luminescent elements 58 may have a sufficient luminescent capacity such that the plurality of luminescent elements 58 is visible in the darkened environment for at least ten hours.

Each of the luminescent elements 58 is positioned on a respective one of the outside surface 22 of the outer wall 18 of the first portion 14 and the exterior surface 30 of the exterior wall 26 of the second portion 16. Each of the luminescent elements 58 associated with the first portion 14 has a length and a width that is greater than a length and a width of each of the luminescent elements 58 associated with the second portion 16. The luminescent elements 58 associated with the first portion 14 are spaced apart from each other and are distributed over a full circumference of the first portion 14, and the luminescent elements 58 associated with the second portion 16 are spaced apart from each other and are distributed over a partial circumference of the second portion 16. Furthermore, each of the luminescent elements 58 associated with the second portion 16 is positioned between the plurality of air holes 35 and the upper edge 32 of the second portion 16.

A pair of feet 63 is each coupled to the exterior surface 30 of the exterior wall 26 of the second portion 16 and each of the feet 63 rests on a support surface 64 thereby inhibiting the ellipsoid 12 from rolling on the support surface. Each of the feet 63 is positioned on opposite sides of the apex of the exterior wall 26 with respect to each other. Additionally, each of the feet 63 has a first end 64 and a second end 66, and each of the feet 63 is elongated between the first end 64 and the second end 66. Each of the feet 63 is curved between the first end 64 and the second end 66 and each of the feet 63 is oriented to curve outwardly from the apex 56 of the exterior wall 26 of the second portion 16.

In use, the objects 50 are positioned in a respective compartment 48 for storage and the first portion 14 is positioned in the closed position. In this way the objects 50 in each compartment 48 can be stored discretely from each other. Furthermore, the luminescent elements 58 facilitate the ellipsoid 12 to be visible in a darkened environment. In this way a user can locate the ellipsoid 12 when the user awakens from sleeping, for example, or other occasion when the user would be in a darkened environment.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure. In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be only one of the elements.

We claim:

1. A luminescent storage the assembly having luminescent elements which are visible in a darkened environment, assembly comprising:

an ellipsoid being divided into a first portion hingedly coupled to a second portion for opening and closing said ellipsoid;

a container being positionable within said ellipsoid, said container including a plurality of dividers, each of said dividers being positioned in said container such that each of said dividers defines a respective one of a plurality of compartments in said container wherein each of said compartments is configured to contain objects for storage; and a plurality of luminescent elements, each of said luminescent elements being integrated into said ellipsoid, each of said luminescent element being comprised of a luminescent material wherein each of said luminescent elements is configured to facilitate said ellipsoid to be visible in a darkened environment;

wherein said first portion has an outer wall, said outer wall having an inside surface and an outside surface, said first portion having a lower edge extending between said inside surface and said outside surface;

wherein said second portion has an exterior wall, said exterior wall having an interior surface and an exterior surface, said second portion having an upper edge extending between said interior surface and said exterior surface;

wherein said first portion has a lip extending around a full circumference of said inside surface of said outer wall, said lip extending beyond said lower edge of said first portion;

wherein said lower edge rests on said upper edge when said first portion and said second portion are in a closed position, said lower edge being displaced from said upper edge when said first portion and said second portion are in an open position; and wherein said second portion has a plurality of air holes each extending through said interior surface and said exterior surface of said exterior wall wherein each of said air holes is configured to pass air through said air holes for ventilating an interior of said ellipsoid when said first portion and said second portion are in said closed position.

2. The assembly according to claim 1, wherein each of said luminescent elements is positioned on a respective one of said outside surface of said outer wall of said first portion and said exterior surface of said exterior wall of said second portion.

3. The assembly according to claim 2, wherein each of said luminescent elements associated with said first portion has a length and a width being greater than a length and a width of each of said luminescent elements associated with said second portion.

4. The assembly according to claim 2, wherein said luminescent elements associated with said first portion are spaced apart from each other and are distributed over a full circumference of said first portion.

5. The assembly according to claim 2, wherein said luminescent elements associated with said second portion are spaced apart from each other and are distributed over a partial circumference of said second portion.

6. The assembly according to claim 2, wherein each of said luminescent elements associated with said second portion is positioned between said plurality of air holes and said upper edge of said second portion.

7. The assembly according to claim 1, further comprising a pair of feet, each of said feet being coupled to said exterior surface of said exterior wall of said second portion wherein each of said feet is configured to rest on a support surface thereby inhibiting said ellipsoid from rolling on the support surface, each of said feet being positioned on opposite sides of an apex of said exterior wall with respect to each other.

8. The assembly according to claim 7, wherein each of said feet has a first end and a second end, each of said feet being elongated between said first end and said second end, each of said feet being curved between said first end and said second end, each of said feet being oriented to curve outwardly from said apex of said exterior wall of said second portion.

9. The assembly according to claim 1, wherein said container includes a bowl portion being concavely arcuate and a lid portion being hingedly coupled to said bowl portion for opening and closing said bowl portion, said bowl portion having an inside surface and a top edge, said outside surface of said bowl portion conforming to said inside surface of said outer wall of said second portion of said ellipsoid when said container is positioned in said ellipsoid, said lid portion having a perimeter edge and a bottom surface, said perimeter edge being hingedly coupled to said top edge such that said bottom surface rests on said top edge when said lid portion is closed, each of said dividers extending away from said inside surface of said bowl portion, said plurality of dividers being perpendicularly oriented with each other such that said plurality of dividers intersects each other at a central point.

10. A luminescent storage the assembly having luminescent elements which are visible in a darkened environment, assembly comprising:

an ellipsoid being divided into a first portion hingedly coupled to a second portion for opening and closing said ellipsoid;

a container being positionable within said ellipsoid, said container including a plurality of dividers, each of said dividers being positioned in said container such that each of said dividers defines a respective one of a plurality of compartments in said container wherein each of said compartments is configured to contain objects for storage;

a plurality of luminescent elements, each of said luminescent elements being integrated into said ellipsoid, each of said luminescent element being comprised of a luminescent material wherein each of said luminescent elements is configured to facilitate said ellipsoid to be visible in a darkened environment;

wherein said first portion has an outer wall, said outer wall having an inside surface and an outside surface, said first portion having a lower edge extending between said inside surface and said outside surface;

wherein said second portion has an exterior wall, said exterior wall having an interior surface and an exterior surface, said second portion having an upper edge extending between said interior surface and said exterior surface;

wherein said first portion has a lip extending around a full circumference of said inside surface of said outer wall, said lip extending beyond said lower edge of said first portion;

wherein said lower edge rests on said upper edge when said first portion and said second portion are in a closed position, said lower edge being displaced from said upper edge when said first portion and said second portion are in an open position;

wherein said second portion of said ellipsoid has a plurality of air holes each extending through said interior surface and said exterior surface of said exterior wall wherein each of said air holes is configured to pass air through said air holes for ventilating an interior of said ellipsoid when said first portion and said second portion are in said closed position; and wherein each of said air holes in said exterior wall of said second portion of said ellipsoid being aligned with a respective one of said compartments for ventilating said respective compartments, each of said air holes being positioned closer to an apex of said exterior wall of said second portion than said upper edge of said second portion.

11. A luminescent storage assembly having luminescent elements which are visible in a darkened environment, the assembly comprising:

an ellipsoid being divided into a first portion hingedly coupled to a second portion for opening and closing said ellipsoid, said first portion having an outer wall, said outer wall having an inside surface and an outside surface, said first portion having a lower edge extending between said inside surface and said outside surface, said second portion having an exterior wall, said exterior wall having an interior surface and an exterior surface, said second portion having an upper edge extending between said interior surface and said exterior surface, said first portion having a lip extending around a full circumference of said inside surface of said outer wall, said lip extending beyond said lower edge of said first portion, said lower edge resting on said upper edge when said first portion and said second portion are in a closed position, said lower edge being displaced from said upper edge when said first portion and said second portion are in an open position, said second portion having a plurality of air holes each extending through said interior surface and said exterior surface of said exterior wall wherein each of said air holes is configured to pass air through said air holes for ventilating an interior of said ellipsoid when said first portion and said second portion are in said closed position;

a container being positionable within said ellipsoid, said container including a plurality of dividers, each of said dividers being positioned in said container such that each of said dividers defines a respective one of a plurality of compartments in said container wherein each of said compartments is configured to contain objects for storage, said container including a bowl portion being concavely arcuate and a lid portion being hingedly coupled to said bowl portion for opening and closing said bowl portion, said bowl portion having an inside surface, an outside surface and a top edge extending between said inside surface and said outside surface of said bowl portion, said outside surface of said bowl portion conforming to said inside surface of said outer wall of said second portion of said ellipsoid when said container is positioned in said ellipsoid, said lid portion having a perimeter edge and a bottom surface, said perimeter edge being hingedly coupled to said top edge such that said bottom surface rests on said top edge when said lid portion is closed, each of said dividers extending away from said inside surface of said bowl portion, said plurality of dividers being perpendicularly oriented with each other such that said plurality of dividers intersects each other at a central point;

a plurality of luminescent elements, each of said luminescent elements being integrated into said ellipsoid, each of said luminescent element being comprised of a luminescent material wherein each of said luminescent elements is configured to facilitate said ellipsoid to be visible in a darkened environment, each of said luminescent elements being positioned on a respective one of said outside surface of said outer wall of said first portion and said exterior surface of said exterior wall of said second portion, each of said luminescent elements associated with said first portion having a length and a width being greater than a length and a width of each of said luminescent elements associated with said second portion, said luminescent elements associated with said first portion being spaced apart from each other and being distributed over a full circumference of said first portion, said luminescent elements associated with said second portion being spaced apart from each other and being distributed over a partial circumference of said second portion, each of said luminescent elements associated with said second portion being positioned between said plurality of air holes and said upper edge of said second portion; and a pair of feet, each of said feet being coupled to said exterior surface of said exterior wall of said second portion wherein each of said feet is configured to rest on a support surface thereby inhibiting said ellipsoid from rolling on the support surface, each of said feet being positioned on opposite sides of said apex of said exterior wall with respect to each other, each of said feet having a first end and a second end, each of said feet being elongated between said first end and said second end, each of said feet being curved between said first end and said second end, each of said feet being oriented to curve outwardly from said apex of said exterior wall of said second portion.

* * * * *